United States Patent [19]

Yagi et al.

[11] 4,307,686

[45] Dec. 29, 1981

[54] INTAKE VACUUM ACTUATED IGNITION TIMING SHIFT DEVICE WITH TWO VACUUM CHAMBERS AND A COMPOSITE SHIFT CHARACTERISTIC

[75] Inventors: Yoshikazu Yagi, Kariya; Eiichi Senda, Oobu; Masami Manabe, Toyota, all of Japan

[73] Assignee: Nippondenso Co., Ltd., Aichi, Japan

[21] Appl. No.: 60,624

[22] Filed: Jul. 25, 1979

Related U.S. Application Data

[63] Continuation of Ser. No. 789,877, Apr. 22, 1977.

[30] Foreign Application Priority Data

May 26, 1976 [JP] Japan ..... 51-67381[U]
May 26, 1976 [JP] Japan ..... 51-67382[U]

[51] Int. Cl.[3] ..... F02P 5/04
[52] U.S. Cl. ..... 123/408
[58] Field of Search ..... 123/407–411

[56] References Cited

U.S. PATENT DOCUMENTS

| | | | |
|---|---|---|---|
| 3,659,501 | 5/1972 | Beard | 123/407 |
| 3,905,342 | 9/1975 | Kobayashi et al. | 123/408 |
| 3,915,132 | 10/1975 | Thornburgh | 123/407 |
| 3,933,166 | 1/1976 | Gould et al. | 123/408 |
| 3,935,843 | 2/1976 | Ludwig | 123/408 |
| 3,965,874 | 6/1976 | Kawai | 123/408 |
| 4,083,335 | 4/1978 | Ohata | 123/408 |

FOREIGN PATENT DOCUMENTS

| | | | |
|---|---|---|---|
| 2227629 | 12/1973 | Fed. Rep. of Germany | 123/408 |
| 1181759 | 2/1970 | United Kingdom | 123/408 |
| 1240091 | 7/1971 | United Kingdom | 123/408 |
| 1245162 | 9/1971 | United Kingdom | 123/408 |
| 1290647 | 7/1972 | United Kingdom | 123/408 |
| 1420104 | 1/1976 | United Kingdom | 123/408 |

*Primary Examiner*—Sal Cangialosi
*Attorney, Agent, or Firm*—Frishauf, Holtz, Goodman & Woodward

[57] ABSTRACT

Two vacuum chambers at the same under-atmospheric pressure produced by connection to the engine intake are provided within a common casing, and intermediate space in the casing at atmospheric pressure. The membrane of one of the vacuum chambers is connected to a flanged sleeve and the control rod which actuates the distributor timing shift is permitted to move over a limited range without coming into driving contact with either flange of the sleeve, while it is always driven by the membrane of the other vacuum chamber, to which it is affixed. Stops, including an apertured partition in the casing of one of them, and springs are provided to produce the limits and slopes of the portions of the shift characteristic that make up the composite characteristic of the device. A bellows is provided where necessary to complete the vacuum chamber system.

14 Claims, 6 Drawing Figures

INTAKE VACUUM ACTUATED IGNITION TIMING SHIFT DEVICE WITH TWO VACUUM CHAMBERS AND A COMPOSITE SHIFT CHARACTERISTIC

This is a continuation of application Ser. No. 789,877 filed Apr. 22, 1977.

This invention relates to a device for shifting the timing of an internal combustion engine in response to the degree of vacuum at the intake of the engine, and more particularly to a device utilizing two vacuum chambers acting on the same timing shift control rod.

In order to obtain a relatively complicated relation between the angular shift of the ignition timing, on one hand, and the intake vacuum, a variety of devices have become known or have at least been proposed. In addition to the shift of the ignition timing (which is commonly expressed as an angle, such as crankshaft rotation angle for the engine) towards earlier or later ignition, it is also required to provide a timing shift characteristic in which with increasing vacuum, after an advance shift there follows a retarding shift, or vice versa. Such an approximately sawtooth-shaped timing shift characteristic has heretofore required at least two ignition timing systems with a switchover and conversion arrangement or a valve provided with a switching mechanism. All of these previously known and previously described systems accordingly consist of several aggregates or subassemblies connected together by wiring or hydraulic lines.

It is an object of the present invention to provide a relatively simple device for producing a timing shift characteristic in which the slope of the characteristic is different in different ranges of underpressure to which the timing shift control is subject without the necessity of wiring or the like between units operating in the different pressure ranges of interest.

SUMMARY OF THE INVENTION

Briefly, two separate vacuum chambers, each with its own membrane for producing movement in response to the degree of underpressure, are provided within a common casing, preferably with some space inbetween at atmospheric pressure. An intermediate body, preferably in the form of a sleeve with inwardly projecting flanges at or near each end, is fixed on one of the membranes and the coupling of the control rod to the membranes is such that the control rod is permitted to move relative to the other of the membranes only within a limited range of relative position and, except for that limited range with respect to the last-mentioned membrane, the control rod is coupled to both membranes.

Preferably, one of the membranes has a larger effective area than the other, in which case this one is the one that is fixed to the intermediate movable body. The two vacuum chambers are connected to the engine intake in such a way that the same amount of underpressure is produced in each vacuum chamber.

Springs are used for the coupling function, first so as to press a shoulder or projection of the control rod against one of the flanges of the intermediate body and second to press the other flange of the intermediate body against a stop plate fixed on the inside of the casing of the device. A buffer feature is provided inside the casing to act as a stop for the movable intermediate member. In a modified form of the device a second intermediate movable member is provided in mirror image relation to the first of them and a third spring is provided to press one of its flanges on the stop plate that is in this case located between the two movable members.

The timing shift device of the present invention has the advantage that relatively complicated timing angle shift characteristics are obtainable with a single mechanical component without any requirement for additional valve, switch-over and conversion arrangements or a switching mechanism. Since in the two vacuum chambers of the device of the present invention the same underpressure appears, only a single vacuum line to the engine is needed.

Further features of the invention will best be understood in connection with the description of illustrative examples of the invention, with reference to the annexed drawings, in which the odd-numbered figures each show a longitudinal section of an illustrative embodiment of a timing shift device according to the invention, not drawn to scale, and the following even-numbered figures show the corresponding timing shift characteristic resulting from the plotting of underpressure against timing angle shift, as follows.

Figure 1:
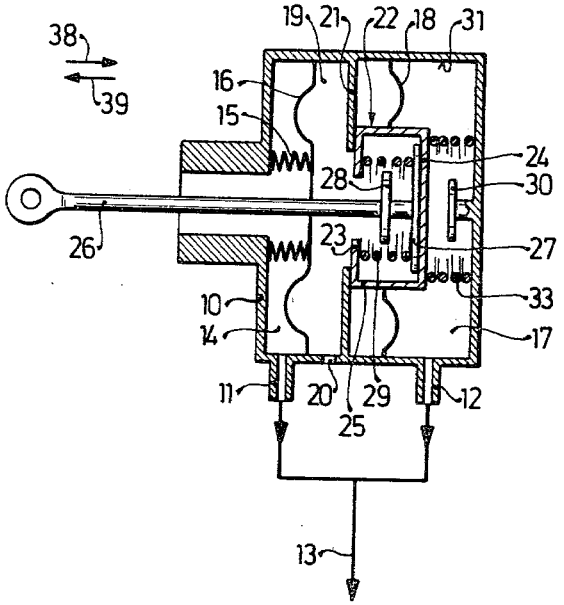
FIG. 1 is a longitudinal section of a first embodiment of a timing shift device according to the invention.

The timing shift device illustrated in FIG. 1 comprises a casing 10 with first and second pipe connections 11 and 12 that for example can be connected through a branched common vacuum line 13 to the intake manifold (not shown) of an internal combustion engine. A first vacuum chamber 14 is formed by a portion of the casing 10, a bellows 15 and a membrane 16; a second vacuum chamber 17 is formed from a section of the casing 10 and another membrane 18. Both membranes and another portion of the casing 10 form an intermediate cavity 19 that is connected to the outside atmosphere through an opening 20. A support plate or stop plate 21 extends into the intermediate cavity 19 from the casing 10.

An intermediate movable member 22 consists essentially of a first flange 23, a disk-like second flange 24 and a sleeve 25 connecting the two flanges. A control rod 26, which for example may be connected to the pivoted plate of an ignition distributor not shown in the drawing, is in force-transmitting coupling with the membrane 18 and has an end piece and a more forwardly located peripheral projection 28. A first spring 29 bears against the flange 23 of the intermediate body 22 and holds the end piece 27 of the control rod 26 to the flange 24. The bottom of the casing 10 has a buffer member 30 that cooperates with the flange 24 of the intermediate movable member 22. A second spring 33 exerts force between the inner wall 31 of the casing 10 and the second flange 24 of the intermediate movable member 22.

One edge of the membrane 18 is fixed to the inner wall 31 of the casing 10 and the other edge, at the center, is fixed to the sleeve or shell 25 of the movable member 22. This membrane 18 has a larger effective area than the membrane 16 which is directly affixed to the cylindrical stem of the control rod 26.

Figure 2:
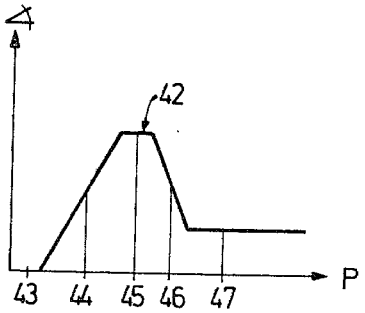
FIG. 2 shows the timing characteristic of the device of FIG. 1.

FIG. 2 shows the timing shift characteristic 42 of the timing shift device embodiment shown in FIG. 1. FIG. 2 is a graph in which on the horizontal axis there is plotted the underpressure on the intake side of the engine which is provided to the two vacuum chambers 14 and 17 and on the vertical axis there is plotted the timing shift angle, which may be conveniently expressed in crankshaft rotation angle with reference to the upper dead point of the cylinder that is being fired.

In FIG. 1 the timing shift device is shown in the position that corresponds to the underpressure that is present in the vacuum chambers at point 43 of the characteristic illustrated in FIG. 2. Since the effective area of the membrane 18 is larger than that of the membrane 16, the underpressure which is of the same magnitude in the two vacuum chambers 14 and 17 produces a resultant force in the direction of advance 38 which is, however, smaller than the bias of the second spring 33. Likewise, the force of the membrane 16 is smaller than the bias of the spring 29. The control rod 26 under these conditions stays in its quiescent position illustrated in FIG. 1.

With increasing underpressure, for example at point 44, the resultant force of the membranes 18 and 16 equals the bias of the spring 33, whereas the force of the membrane 16 remains still less than the bias of the spring 29. Accordingly the control rod 26 makes a normal displacement as shown by the arrow 38, which produces a retarding of the ignition timing in the distributor not shown in the drawing.

With underpressure increasing still further, for example at point 45, the displacement movement of the control rod 26 is limited by abutment of the intermediate movable body 22 on the buffer member 30 and at this point the maximum normal shift angle is reached. The force of the membrane 16 is still smaller than the bias of the spring 29.

With still further increasing underpressure, for example at point 46, the force of the membrane 16 now overcomes the bias of the spring 29, so that on the one hand the intermediate movable body 22 is again abutting the stop plate 21 and on the other hand the end piece 27 of the control rod 26 is pulled away from the flange 24 of the intermediate movable body 22 far enough to produce an equilibrium in which the bias of the spring 29 balances the force of the membrane 16. The control rod 26 now makes a displacement in the opposite direction indicated by the arrow 39, providing a reverse timing shift, which is to say a shifting of the distributor timing in the direction of spark advance.

If now the underpressure climbs still further, as for example at point 47, the radial projection 28 of the control rod 26 hits the flange 23 of the intermediate movable 22 which is now abutting the stop plate 21, thus reaching the maximum reverse shift of timing in the direction of arrow 39. The maximum reverse shift angle corresponds to the spacing between the upper and lower horizontal sections of the timing characteristic 42. Thus after a normal timing shift there follows a reverse timing shift.

If now the underpressure in the engine drops, the control rod position is given by the return course retracing the characteristic 42, neglecting some unavoidable or residual hysteresis. After a reverse timing shift there now follows a normal timing shift.

Figure 3:
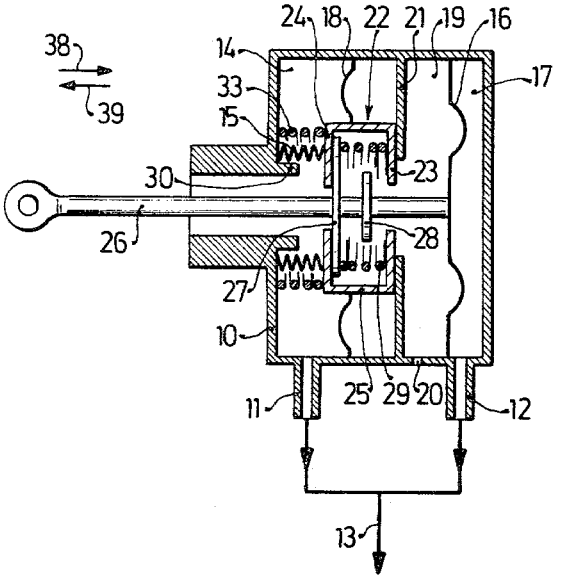
FIG. 3 is a longitudinal section of a second embodiment of a timing shift device according to the invention.
Figure 4:
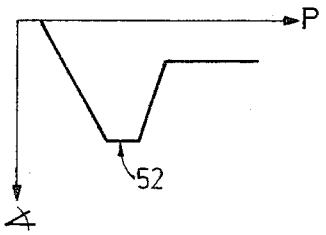
FIG. 4 is a diagram showing the shift characteristic of the device of FIG. 3.

The second illustrative embodiment shown in FIG. 3 is similar in construction to the first which has already been described, so that identical or similarly operating parts are designated with the same reference numerals. This embodiment produces a timing shift characteristic 52 shown in FIG. 4 which has the relation of a mirror image to the characteristic 42 shown in FIG. 2 reflected with reference to the horizontal axis. Underpressure in the engine is again plotted on the horizontal axis, but on the vertical axis the reverse shift angle is plotted instead of the normal shift angle plotted in FIG. 2. In other words, increase of angle shown upwards in FIG. 4 is in the direction of spark advance, whereas in FIG. 2 it was in the direction of spark retard, the latter being regarded as normal shift because it was the historically earliest type of shift to be provided to a spark distributor in response to increasing engine intake vacuum. The reverse shift in the arrow direction 39 as well as the normal shift in the arrow direction 38 occurs in a manner analogous with that described for the first illustrative embodiment.

Figure 5:
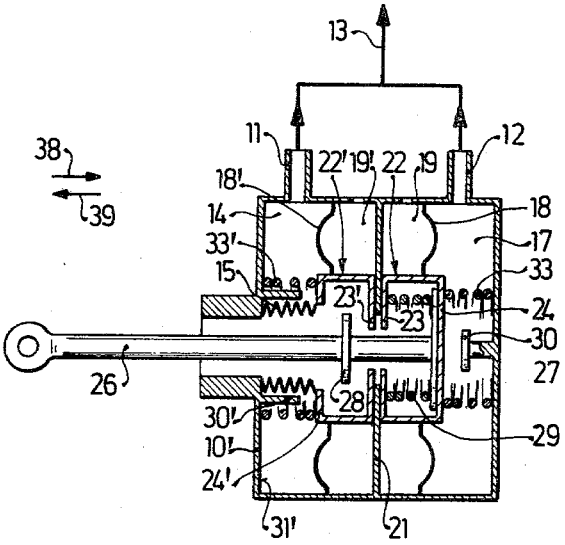
FIG. 5 is a longitudinal section of a third and modified embodiment of a timing shift device according to the present invention.

The timing shift device shown in FIG. 5 also shifts the ignition timing in response to the underpressure in the engine in the respective directions of spark advance and spark retard. The casing 10', similarly to the casing 10 in FIG. 1, forms a second vacuum chamber 17 with the membrane 18. A first spring 29 likewise bears against a first flange 23 of the intermediate movable member 22 and presses the control rod 26 against the second flange 24 of the movable member. The second spring 33 is provided between the casing 10' and the flange 24, so that the intermediate movable member 22 is pressed against the stop plate 21 which in this case separates the intermediate cavity 19 from the intermediate cavity 19'. The first vacuum chamber 14 is formed by a section of the casing 10', the bellows 15 and the membrane 18, similarly to the manner in which the corresponding chamber is formed in the structure of FIG. 3.

In mirror image configuration relative to the intermediate movable body 22 there is in this case provided a second intermediate movable body 22', between the second flange 24 of which and the inner wall 31' of the casing an additional spring 33' operates and presses the first flange 23' of this second intermediate movable body 22' against the separating wall provided by the stop plate 21. In this arrangement the force of the spring 33' is greater than that of the spring 33. A first buffer 30 also limits the normal timing shift by blocking the path of the intermediate movable body 22, whereas the maximum reverse shift is limited by abutment of the second intermediate movable body 22' against the buffer 30' which similarly blocks its path.

Figure 6:
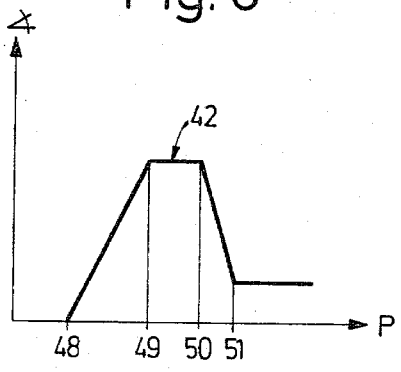
FIG. 6 is a diagram of the timing shift characteristic of the device of FIG. 5.

The operation of the illustrative embodiment shown in FIG. 5 can be understood with reference to the diagram provided in FIG. 6. The underpressure in the engine intake is again plotted on the horizontal axis and the angular shift of the ignition timing on the vertical axis. The timing characteristic 42 shown in FIG. 6 is composed as follows.

Up to a pressure corresponding to point 48 the device stays in the quiescent position illustrated in FIG. 5, because the force of the membrane 18 and that of the membrane 18' are respectively smaller than the bias of the springs 33 and 33'. At the point 48, however, the force of the membrane 18 is equal to the bias of the spring 33, while the bias of the spring 33' is still as before greater than the force of the membrane 18'.

If the underpressure increases somewhat, the force of the membrane 18 likewise increases and overcomes more and more the bias of the spring 33, so that the control rod 26 executes a normal shift in the direction of the arrow 38, until the intermediate movable body 22 comes up against the buffer 30 and at the same time the projection 28 of the control rod 26 comes up against the flange 23' of the second intermediate movable body 22'. This maximum normal shift is reached at point 49.

At point 50 equilibrium is finally reached between the force of the membrane 18', on the one hand, and the sum of the biasses of the springs 29 and 33' on the other. If the underpressure increases further, the force of the membrane 18' becomes steadily greater and overcomes more and more the forces exerted by the springs 29 and 33'. The control rod 26 thus receives a reverse shift in the direction of the arrow 39, which corresponds to the section of the characteristic 42 between the points 50 and 51. This reverse shift reaches its maximum value at point 51 by the stopping of the flange 24' of the second intermediate movable body 22' against the buffer 30'.

If the underpressure now falls back, the timing shift device follows the path marked out by the timing shift characteristic 42 in the opposite direction.

The last-described illustrative example, shown in FIG. 5, makes it possible to provide a reverse timing shift after a normal timing shift and vice versa.

Although the invention has been described with reference to specific illustrative embodiments, it will be understood the further modifications and variations are possible within the inventive concept.

We claim:

1. Timing shift device for acting on the ignition distributor of an internal combustion engine to advance or retard the ignition timing in response to the intake vacuum of the engine, comprising, in combination:

a casing (10);

a bellows member (15) and a first membrane constituting, together with said casing, a first vacuum chamber said first vacuum chamber (14) having a first duct means (11) through said casing;

a second membrane having an effective area different from that of said first membrane and constituting, together with said casing, a second vacuum chamber (17) said second vacuum chamber (17) having a second duct means (12) through said casing;

an intermediate space being provided between first and second vacuum chambers which communicates with the exterior of said casing so that said space will be at atmospheric pressure;

common duct means (11) connecting said first and said second duct means to an intake duct of said engine and for thereby subjecting both of said vacuum chambers to the same underpressure relative to atmospheric pressure;

an elongated control member (26) for actuating the timing shift mechanism of an engine ignition distributor, said control member having a stem directly connected to that one of said membranes having the smaller effective area, said control member stem being connected to said one of said membranes at a part thereof that is movable relative to said casing and having at least one projection or shoulder thereon for modifying the actuation of said control member by said one of said membranes;

an intermediate movable member (22) affixed to the other of said membranes having a first flange and a second flange extending into the path of said projections or shoulders of said control member stem for transmission of force between said intermediate member (22) and said control member (26) in some but not all relative positions thereof, the remainder of said intermediate member being in the configuration of a sleeve from which said flanges extend upwardly, and a first spring (29) positioned so as to bear against said first flange (23) and to press one of said projections of said control member stem against said second flange (24).

2. Timing shift device as defined in claim 1, in which a stop plate (21) is fixed on the interior of said casing in said space between said first and second vacuum chambers and in which, further, a second spring (33) is provided and is disposed so as to press said intermediate member (22) against said stop plate (21).

3. Timing shift device as defined in claim 1, in which a stop plate (21) is provided in fixed relation to said casing in said space (19) between said first and second vacuum chambers (14, 17) and in which, further, a second spring (33) is provided and is disposed so as to press said first flange (23) of said intermediate member (22) against said stop plate (21).

4. Timing shift device as defined in claim 3, in which a buffer member (30) is provided on the interior of said casing and disposed so as to limit by abutment thereon of said second flange (24) of said intermediate member, the extent of movement of said control member (26) in one direction produced by the pressure of said second spring (33).

5. Timing shift device as defined in claim 3, in which one of said projections (28) of said control member stem is disposed so as to limit in one direction the movement of said control member (26) by said first spring (29) by abutment against said first flange (23) of said intermediate member (22) when the latter is butting against said stop plate (21).

6. Timing shift device as defined in claim 4, in which one of said projections (28) of said control member stem is disposed so as to limit in the opposite direction to the direction referred to in claim 6 the movement of said control member (26) by said first spring (29) by abutment against said first flange (23) of said intermediate member (22) when the latter is butting against said stop plate (21).

7. Timing shift device for acting on the ignition distributor of an internal combustion engine to advance of retard the ignition timing in response to the intake vacuum of the engine, comprising, in combination:

a casing (10');

a bellows member (15) and a first membrane (28') constituting, together with said casing (10'), a first vacuum chamber (14') equipped with first duct means (11);

a second membrane (18) constituting, together with said casing (10'), a second vacuum chamber (17) equipped with second duct means (12);

said casing (10') having a configuration providing intermediate cavities (19,19') therein at atmospheric pressure between said first and second vacuum chambers (14,17);

common duct means for connecting both first and second duct means to an intake duct of said engine which is normally at under-atmospheric pressure during engine operation and for thereby placing both of said vacuum chambers at the same under-atmospheric pressure;

an intermediate movable member (22) affixed to one of said membranes, and a control rod (26) for actuating the timing shift mechanism of an engine ignition distributor, said control rod being coupled to said intermediate movable member (22), the range of displacement within which the position of said control rod can be shifted relative to the position of the other of said membranes.

8. Timing shift device as defined in claim 7, in which said intermediate movable member (22) has the general configuration of a sleeve having a first and a second flange (23, 24), and in which a first spring (29) bears against said first flange (23) and thereby holds said control rod (26) pressed against said second flange (24).

9. Timing shift device as defined in claim 8, in which a stop plate (21) is provided in the interior of said casing (10') subdividing the space in said interior lying between said first and second vacuum chambers (14, 17) into two intermediate cavities (19, 19') and in which, further, a second spring (33) is provided for holding said first flange (23) against said stop plate (21).

10. Timing shift device as defined in claim 9, in which the interior of said casing (10') is provided with a buffer member (30) for limiting the control of movement of said control rod (26) in one direction when said second flange (24) buts against said buffer member (30) against the force of said second spring (33).

11. Timing shift device as defined in claim 9, in which a second intermediate movable member (22') is provided in mirror image relation to said first-mentioned intermediate movable member (22) and in which, further, an additional spring (33') is provided between the second flange (24') of said second intermediate movable member (22') and the inner wall (31') of said casing (10') for pressing said first flange (23') of said second intermediate movable member (22') against said stop plate (21).

12. Timing shift device as defined in claim 11, in which the force of said additional spring (33') is greater than the force of said second spring (33).

13. Timing shift device as defined in claim 11, in which a second buffer means (30') extending into the interior of said casing (10') from said casing for limiting the control movement of said control rod (26) in the direction opposite to the one direction thereof first mentioned by said second flange (24') of said second intermediate movable member (22') coming to rest against said second buffer means (30').

14. Timing shift device as defined in claim 11, in which a projection (28) is provided on said control rod (26) for limiting the control movement of said control rod (26) in the direction opposite to the one direction of movement thereof first mentioned by abutment of said projection (28) of said control rod (26) against said first flange (23') of said second intermediate movable member (22').

* * * * *